United States Patent [19]

Beausoleil

[11] 4,432,482

[45] Feb. 21, 1984

[54] DISPENSER FOR ROLLED SHEET MATERIAL

[76] Inventor: Armand S. Beausoleil, 12501 S. Prairie Ave., Hawthorne, Calif. 90250

[21] Appl. No.: 255,051

[22] Filed: Apr. 17, 1981

[51] Int. Cl.[3] ..... B65H 17/22; B65D 71/00

[52] U.S. Cl. ..... 226/181; 225/46; 242/55.53

[58] Field of Search ..... 242/55.53, 55.3; 312/38, 39, 40; 225/46, 47; 226/181, 188

[56] References Cited

U.S. PATENT DOCUMENTS 3,127,121 3/1964 Babin ..... 242/55.53

*Primary Examiner*—Leonard D. Christian

*Attorney, Agent, or Firm*—Howard L. Johnson

[57] ABSTRACT

Cabinet useable for dispensing any tear-off length of a variety of rolled sheet material ranging from paper towels or toilet tissue to bandages or wrapping material. Following each selected withdrawal/severance from outlet mouth, sheet advance mechanism comprising gear driven contact roller is manually activated by reciprocation of thrust-inserted row of rack teeth so as to effect advance of fresh leading edge of sheet between it and supporting free roller. Latter includes fixed tangential fingers to insure non-clinging of sheet to free roller.

2 Claims, 5 Drawing Figures

DISPENSER FOR ROLLED SHEET MATERIAL

BACKGROUND OF THE INVENTION

This invention relates to dispensers for rolled sheet material such as toilet tissue, paper toweling, wax paper or aluminum foil (such as used to wrap edibles), gauze bandages or other body wrappings, and similar flexible strip material including ribbons and wall paper. Such strip lengths are usually merchandized in roll form primarily for cleanliness and ease of handling, and may later be dispensed at time of use directly from the individual wrapper or container, or the roll may first be mounted in a dispensing cabinet which may or may not include other handling mechanism in addition to an axial spindle for the hollow tube which holds the sheets. In any event, withdrawing unequal lengths from the roll from time to time, may present handling problems: if the dispenser lacks flow-retard means, a quick start of the roll may deliver greater than the desired length, resulting in loss or spoilage. Or a close severance at the delivery mouth may leave the user without any projecting tab or fragment to grasp in order to renew the unwinding. In addition, such material as terry cloth or plastics like "saran wrap" have a tendency to resist unrolling due to adjacent surface layers clinging to each other; hence some minimal energy—either manual or mechanical—must be applied for their separation upon unrolling.

BRIEF SUMMARY OF THE INVENTION

Accordingly the invention provides a dispenser having control means for making available upon unwinding (i.e. manually accessible) any desired length of rolled sheet material as may be drawn from a roll which has been mounted in the dispenser. Such dispenser may also form the primary carton or packaging in which an individual roll is distributed or sold. Alternately, the dispenser may be more-or-less permanently located at a point of use (kitchen, bath, workroom/garage, laboratory) for the sheet material, so that successive rolls can be installed in the dispenser from time to time as required. The dispenser, in addition to providing (usually) axial spindle means for the roll (or bearing sockets if the roll already carried a spindle), provides an outlet mouth (often with a severance edge) and a first roller parallel-/adjacent thereto positioned to frictionally engage and draw (unroll) a leading edge of the sheet material so as to advance it to and beyond the dispensing outlet.

This first roller is free rolling; that is, by its rotation it may move the overlying sheet material through the outlet mouth, or alternately, the (manually) unrolling sheet material may rotate the thus contacted (first) roller. A second (gear-driven) roller is adjustably positioned for peripheral-contact driving engagement with the first roller when selectively pressed against the opposite face of the unrolling sheet material; that is, drive rotation of the second roller simultaneously rotates the first roller (in the opposite direction) and unrolls or "draws" the intervening sheet material tangentially between them so that the sheet progressively emerges through the outlet mouth.

A manually operable starter or clutch element having rack teeth is selectively (limited) engagable with a gear segment of the second roller so as to produce an initial joint rotation of the first and second rollers and consequent forward projection (unrolling) of the sheet material therebetween so as to emerge it through the outlet mouth. The leading edge of the sheet can then be manually grasped and drawn out to any extent desired, with the second roller automatically withdrawn from engagement. In addition, for particular use with self-clinging sheet material, the first roller is formed with circumferential grooves which seat corresponding tangentially-upward extending prongs or contact fingers.

DETAILED DESCRIPTION OF PREFERRED EMBODIMENT

Figure 1:
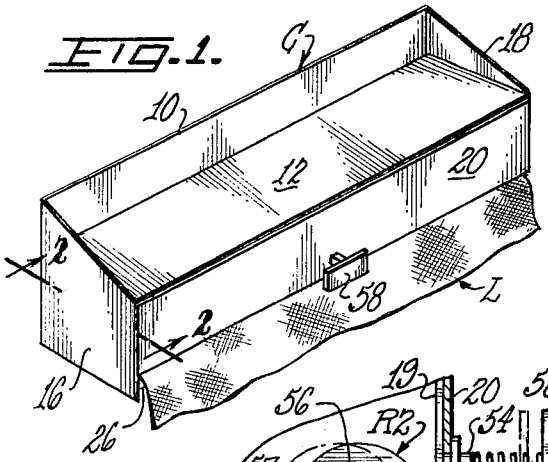
FIG. 1 is a perspective view from above of the assembled sheet dispenser.
Figure 2:
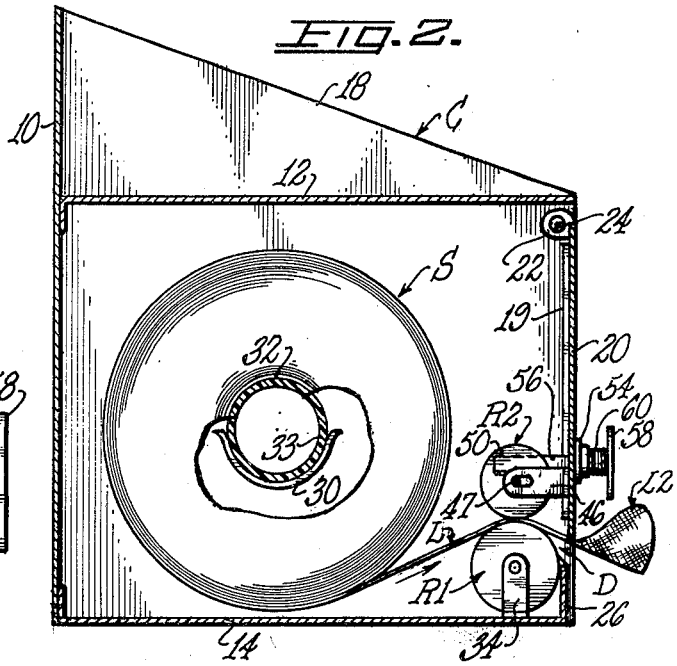
FIG. 2 is a vertical transverse sectional view taken through the assembly along line 2—2 of FIG. 1.
Figure 3:
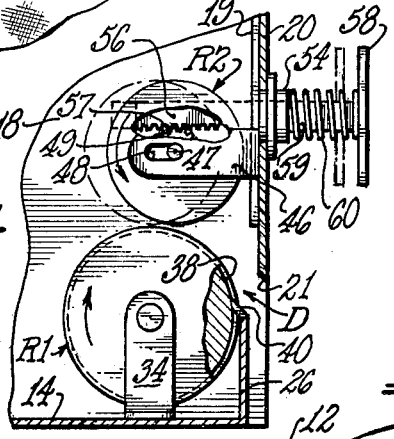
FIG. 3 is an enlarged sectional detail of the actuating mechanism of FIG. 2.
Figure 4:
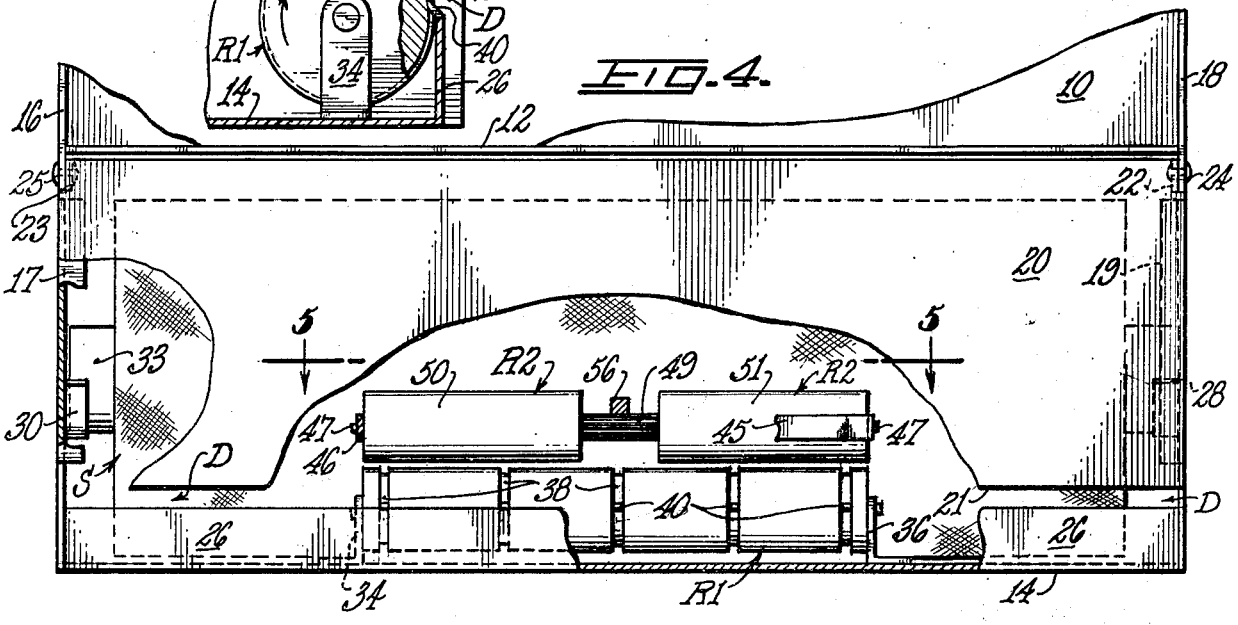
FIG. 4 is a front elevational view of the assembly with portions of the front closure broken away to show the forward pair of rollers.
Figure 5:
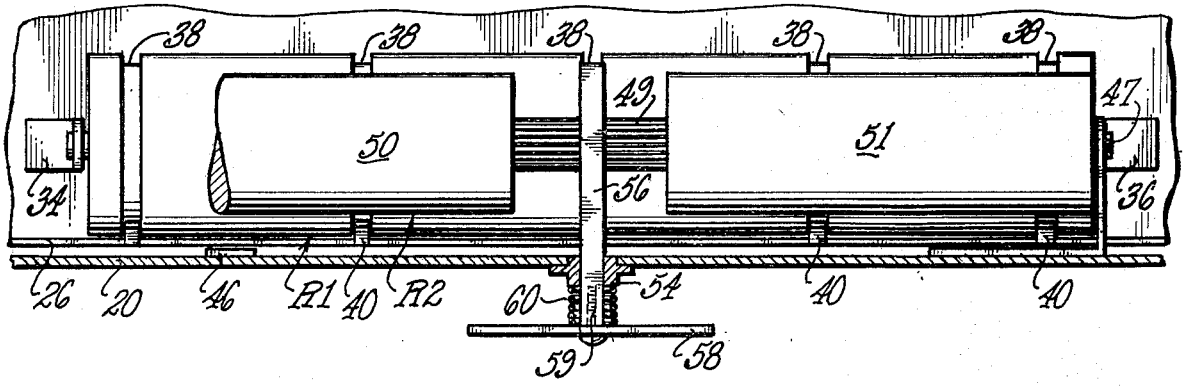
FIG. 5 is an enlarged horizontal sectional view taken through the front closure along line 5—5 of FIG. 4.

The dispenser assembly includes a housing or cabinet C conveniently formed of sheet metal or other edge-joined rectangular panels, providing a back 10, top 12, bottom 14, ends 16, 18, and front 20 wall, the latter being coupled to the respective end panels by attachment tabs 22, 23 and pivot studs 24, 25 so as to form a hinged closure for the cabinet. In use, the lower transverse border 21 of the closure panel 20 forms a separation or tear-off edge (FIG. 3) for successive lengths of sheet material as are withdrawn from the cabinet from time to time through a delivery mouth or outlet D. Spaced below the tear-off cross edge 21 by the height of the outlet D is a cross wall or panel 26 which completes the retention enclosure or cabinet. When downswung, the closure 20 rests against the vertical support ledges 17, 19.

Within the cabinet, suitable means are provided for rotatably mounting a roll of sheet material S, such as a longitudinally aligned pair of arcuate cradles 28, 30 which thus loosely support a spindle 33 within the central tube 32 of the roll S. In some instances (e.g. toweling or toilet tissue) the roll of sheet material S may be divided into equal-length segments by transverse perforations or scoring, which segments are thus more easily separated at the severance edge 21.

Located along the forward margin of the cabinet floor 14 and generally axially parallel to the outlet mouth D is a free roller R1, jointly supported between a pair of end brackets 34, 36. The roller is characterized by an axially separated series of shallow peripheral grooves 38 in each of which is (loosely) located a thin elongated prong or finger 40 which prongs are directed upward from the upper margin of the panel 26, generally tangentially to the roller and pointed opposite to its direction of rotation. That is, the free ends of the prongs extend contrary to the rotational direction of the sheet material so that the latter does not wind itself back on the roller but instead issues through the outlet mouth D. Such prongs are particularly useful in handling such material as "saran wrap" and other plastic sheet material which tends to cling to contacted material; the leading edge L2 of the unrolling material is thus immediately directed outward to a hand grasp position, from which the user can than withdraw any desired length of continuous material (whether perforated or not).

Above the lower roller R1, secured to the inner surface of the closure 20 by hanger brackets 45, 46 is an adjustable and reversable drive roller R2, having its axle ends 47 located in a slide track 48, the inner end of which serves as a bearing support for the axle when slid to such position. An intermediate length of the drive roller R2 is formed of reduced diameter and provided with a circumferential series of axially directed gear teeth 49. Roller segments 50, 51 on either side thereof are smooth surfaced and disposed to make rolling contact with the face of the free roller R1 when pressed thereagainst, which is effected by the whole roller unit R2 being moved or slid "inward" to the bearing end of the track 48 (i.e. to the left as viewed in FIG. 3).

An actuating or "starter" subassembly is mounted on the hinged closure 20 in position for selective engagement and disengagement with the drive roller R2. Such starter unit includes a tubular fitting 54 which fixedly traverses the front wall 20 of the cabinet and journals a longitudinally reciprocable rack 56, the inner length of which has its underface formed with a series of rack teeth 57 (FIG. 3) which are drive engageable with the annular gear teeth 49 of the roller R2. The outer projecting end of the rack terminates with a transverse operating handle 58 and such outer length 59 carries a helical compression spring 60, thus biased normally to hold the handle 58 outward from the fitting 54, that is, spaced from the front panel 20 so as to be readily grasped by the user.

Upon the rack 56 being started inward by thrust pressure on the handle 58, the gear engaged teeth 57 initially slide the composite roller R2 and its axle 47 inward by the length of the slide track 48 (i.e. to the left in FIG. 3) and locate the upper roller segments 50, 51 of R2 in driving or frictional contact with the free roller R1, as by pressure exerted upon the intervening sheet material L. Further thrust then progressively counter-rotates the lower roller R1, causing the leading edge L2 of the sheet material to be moved out through the outlet mouth D to a position where the initial length can be manually grasped (and further withdrawn). At the same time, upon manual release of the inserted rack or "plunger" 58 by the operator, the coil spring 60 effects retraction of the rack bar 56 and consequent reversal of the teeth-engaging geared segment 49 of the drive roller R2. This causes the upper roller R2 to disengage from the lower roller R1, with the return of its axle 47 to the opposite end of the track 48 (i.e. to the right in FIG. 3). Occasionally one insertion of the "plunger" may not be sufficient to eject the leading edge L2 far enough for the operator to get a good grasp on it; the plunger may then be pushed in another time or times as required.

I claim:

1. A sheet dispenser comprising means for rotatably disposing a roll of flexible sheet material therein in position for unrolling, said dispenser having an outlet mouth for emergence therethrough of selected lengths of sheet material as may be drawn from said roll, said mouth including a severance edge extending across the width of sheet material and disposed for severance of a selected length thereof which has been withdrawn from the mouth, a first roller carried by the dispenser in position to rollingly support one side of said sheet material adjacent the outlet mouth, a slide track disposed transverse to said outlet mouth, a second roller having an axle slidably supported upon said track for selective displacement therealong between a retracted position wherein the two rollers are spaced apart and an extended position wherein said axle is rotatably disposed adjacent the end of said track with the circumference of the second roller located in frictional contact with the opposite side of said first-roller-supported sheet material and is thus positioned upon its rotation to frictionally impart rolling movement to the first roller by pressure through the intervening sheet material, thereby moving the intervening sheet through the outlet mouth, said axle having gear means located intermediate its ends, an ejection starter unit carried by the dispenser adjacent the outlet mouth and comprising a reciprocable plunger adapted selectively to move said second roller along the slide track from retracted to extended position and thereat to drivingly engage said gear means, thereby rotating the two rollers and moving the intervening sheet material through the outlet mouth, said plunger having resilient means for its return to retracted position with disengagement of said gear means and the second roller spaced from the first roller so as to permit the ejected sheet material to be further withdrawn manually and then severed at the severance edge.

2. A sheet dispenser according to claim 1 wherein said first roller is formed with at least one circumferential groove and has an upstanding prong tangentially disposed therein adjacent said outlet mouth and directed opposite to the directional rotation of the roller, thereby to prevent the supported sheet material from winding itself upon the roller.

* * * * *